US006034337A

United States Patent [19]

Siegert

[11] Patent Number: 6,034,337

[45] Date of Patent: Mar. 7, 2000

[54] INTERLOCKING COVER IN SWITCH ARRANGEMENT HAVING PRIMARY AND SECONDARY FUNCTIONS

[75] Inventor: Franz-Josef Siegert, Herrenberg, Germany

[73] Assignee: DaimlerChrysler AG, Germany

[21] Appl. No.: 09/249,808

[22] Filed: Feb. 16, 1999

[30] Foreign Application Priority Data

Feb. 14, 1998 [DE] Germany ..... 198 06 147

[51] Int. Cl.[7] ..... H01H 9/20; H01H 3/16

[52] U.S. Cl. ..... 200/50.32; 200/1 B; 200/61.58 R; 200/61.85; 200/334; 200/50.33; 180/333

[58] Field of Search ..... 200/1 B, 5 R, 200/5 A, 17 R, 50.01, 50.32–50.38, 52 R, 61.58 R, 61.85, 333, 334, 335, 336, 339; 180/333

[56] References Cited

U.S. PATENT DOCUMENTS 5,140,112 8/1992 Ritter ..... 200/61.58 R
5,218,290 6/1993 Beckert et al. ..... 324/115
5,777,394 7/1998 Arold ..... 307/10.1

FOREIGN PATENT DOCUMENTS 40 01 440 C1 1/1990 Germany .
39 19 099 A1 12/1990 Germany .

*Primary Examiner*—J. R. Scott
*Attorney, Agent, or Firm*—Evenson, McKeown, Edwards & Lenahan, P.L.L.C.

[57] ABSTRACT

A switch arrangement for switching a principal function and for switching at least one secondary function by which at least one secondary function is switchable whenever the principal function is turned on. The control or controls for switching the at least one secondary function is covered by a cover whenever the principal function is not activated, and the cover of the control or controls for the at least one secondary function is moved such that the control or controls become visible and accessible when the principal function is activated.

17 Claims, 2 Drawing Sheets

INTERLOCKING COVER IN SWITCH ARRANGEMENT HAVING PRIMARY AND SECONDARY FUNCTIONS

BACKGROUND AND SUMMARY OF THE INVENTION

This application claims the priority of German Application No. 198 06 147.1, filed Feb. 14, 1998, the disclosure of which is expressly incorporated by reference herein.

The present invention relates to a switch arrangement for controlling a principal function and at least one secondary function which can be activated whenever the principal function is activated.

Such switch arrangements are known in a great number of applications relating to controls and regulators, for example. For multiple principal and secondary functions, however, these switch arrangements suffer from the problem of failing to provide a user with the ability to maintain an optimum view of the arrangement of the controls. This applies to the situation where the controls of all the principal and secondary functions are within a user's sight. This is due to, depending on the application, the fact that the number of controls can become comparatively great. Furthermore, the user is required to perform a number of routines, if he is to retain an overview of an increasingly great number of controls indicating which principal and secondary functions can or cannot be actuated. Conventionally, a user guide is provided which essentially consists of the appropriate information pertaining to the present setting of the switches, as indicated on a display. In the guise of providing help to the user, this display indicates which principal and secondary functions can be operated by which specific control. It is possible in such a system, for example, to provide for a multiple use of a control. In essence, depending upon the momentary state of the switches, several functions can be activated via this control. The function that can be engaged in a given moment is indicated on the display.

It is furthermore known to arrange the controls directly on the display. Here, the display is in the form of a so-called touch screen. In such a display an evaluation can be made as to whether and at which point the display is to be touched by a user. Because the controls are indicated at various positions on the display, it is possible to estimate which switch functions are to be employed. Such a touch screen provides an especially striking arrangement of the displayed information and the controls that are shown.

Such systems are used, for example, in control stations from which specifications are to be issued via which comparatively complex systems are controlled or regulated. Furthermore, such systems are known for use in information systems in which management is to be performed by the user (including users who are less familiar with handling technical systems). This applies, for example, in museums or similar institutions which address themselves to a comparatively broad range of public, but where the public is to be given information in an attractive form, i.e., without information overload. The user can gradually select the information that interests him (in this instance).

In view of the foregoing, it is an object of the present invention to provide a switch system, in which one or more secondary functions can be combined with a switchable principal function, which has a clear, appealing layout. It is also an objective of the invention to provide a control arrangement which is rational. To this end, in order to achieve a clear and appealing layout of the apparatus on which the controls are arranged, it is important to provide a limited number of visible controls.

These and other objects and advantages are achieved by a switch system according to the invention, in which the control or controls for switching the at least one secondary function are concealed by a cover when the principal function is not activated, and when the principal function is activated, the cover of the control or controls for operating the at least one secondary function is shifted such that the control or controls become visible and accessible.

As a result, the controls of the secondary functions are not visible at a time when the secondary functions cannot be operated, since the principal function has not been activated. This proves especially advantageous in systems where the number of available secondary functions is limited, because the number of the controls that are to be concealed by the cover when the principal function is inactive is also limited. In general, therefore, the cover does not become too large overall, and the distance which the cover needs to move in order to reveal the controls (i.e., make them visible and accessible and then cover them again) remains optimal.

In operating the system, the user is not confronted with a great number of controls with which he must first become familiar in order to determine which control produces which function. Instead, the user sees only the controls by which functions can also be activated. In comparison to the known switch systems, it is advantageous in that conventional switches can still be used in the manner as set forth in the subject matter according to the present invention. Especially when the number of primary and secondary functions is limited, very little of the technical coverage of a display (especially a touch screen) is utilized. In view of this, it appears that the touch-screen technique is comparatively expensive when used in such applications. In comparison, a less costly solution is achieved by the present invention. By using conventional controls, the possibility is created for a tactile feedback of the operation of a particular control.

In an embodiment of the switch arrangement according to the invention, the cover is mechanically connected to the control for activating the principal function. Thus, the movement of the cover is performed directly without any other intervention, by operating the control which actuates the principal function.

In an embodiment of the switch arrangement according to the invention, the cover is simultaneously the control which serves as a handle for activating the principal function. A switch arrangement of this kind is especially suitable for operating the hood of a motor vehicle, because with this switch arrangement the function to be operated can be marked on the button of the switch in an obvious manner, as well as its movement when the switch is operated.

In yet another embodiment of the switch arrangement according to the invention, the control for activating the principal function is a sliding switch. Thus, it is possible to make the cover and its movement especially simple.

In still another embodiment of the switch arrangement according to the invention, the control for activating the principal function is a rotary switch. Since the cover amounts to a portion of the circular area over which it passes when rotated, an especially space-saving arrangement of the switches is possible.

In another embodiment of the switch arrangement according to the invention, the cover conceals sectors of a circle around the axis of rotation of the rotary switch. Here, the cover rotates with the rotary switch when the latter is operated. The result is a simple structural configuration of the switch arrangement and a simultaneous use of conventional controls which the user is familiar with.

In a further embodiment of the switch arrangement according to the invention, the control or controls are designed for the operation of the at least one secondary function as a pushbutton switch, toggle switch or momentary contact switch. In the case of the controls for the secondary function or functions, this results in the possibility of using controls which the user is familiar with.

In another embodiment of the switch arrangement according to the invention, different principal functions can be activated via the principal function control (according to its position). Here, the cover is moved in correspondence to the positions of this control such that controls of available secondary functions which can be operated depending upon the principal function that has been activated are visible and accessible.

With this switch arrangement, a plurality of principal functions can be operated via a single control. Controls of secondary functions become visible and accessible depending on the principal function that is activated. Depending on which position the principal function control assumes, these controls therefore become exposed or covered.

In accordance with another embodiment of the switch arrangement of according to the invention, when the principal function is deactivated, the corresponding secondary functions are positively deactivated when their controls become covered by the cover. This occurs as the control of the principal function is moved to the "OFF" position. This deactivation can directly occur when the switch operation is started by directly moving the control of the principal function to the "OFF" position. In a similar manner, it is conceivable (in the case of a toggle switch, for example) to provide for a positive operation of the secondary function control by the cover when the cover passes over this switch. The deactivation is then initiated by the operation of the control of the secondary function, which in turn is caused by deactivating the principal function.

Contemplated embodiments of the switch arrangement according to the invention are used in a motor vehicle, for example.

Specifically, in a motor vehicle, it has proven advantageous for only those controls to be visible by which a switching function can be exercised, even a momentary one. This can give the user a quick orientation. This is especially advantageous when the user is the driver himself, because when operating a switch he receives very little distraction from watching the traffic.

The switch arrangement can be used, for example, in a combination radio and cassette player. Here, the "radio" and "cassette" functions are the principal functions. When the "cassette" function is turned on, the controls of the secondary functions which relate to the fast-forward, rewind, record, start and stop keys as well as the cassette eject button become visible and accessible. If desired, a CD player can be controlled as an additional principal function, the choice of tracks being again a secondary function.

Another application in a motor vehicle can be, for example, the operation of one or more opening means.

Other objects, advantages and novel features of the present invention will become apparent from the following detailed description of the invention when considered in conjunction with the accompanying drawings.

DETAILED DESCRIPTION OF THE DRAWINGS

Figure 1:
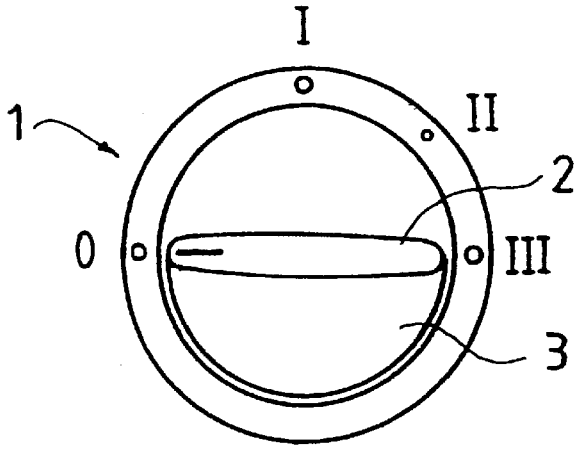
FIGS. 1 through 3 show a control for switching several principal functions, in different positions.
Figure 2:
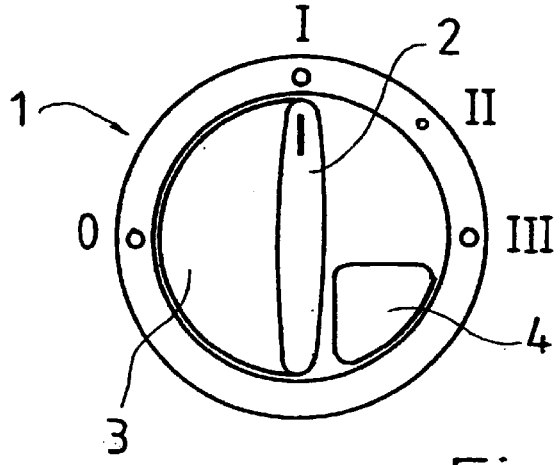
Figure 3:
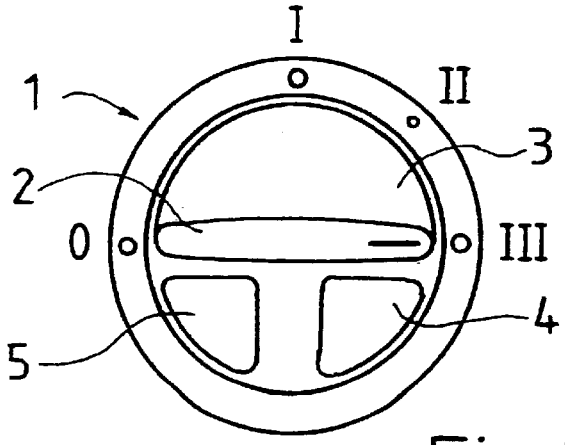

The control 1 shown in FIGS. 1 to 3 is a rotary switch in a motor vehicle by which the hood of a car can be opened. In the position shown in FIG. 1 (position "0") the hood is closed. The control 1 is constructed such that it has a handle 2 which extends along the diameter of the circle which is swept by the handle 2 when the rotary switch is turned. Also shown is a semicircular cover 3 which is applied to the handle 2. Upon a movement of the handle 2 and the activation of the principal function which it entails, the cover 3 turns with it, and in each position of the rotary switch covers another sector of the circle.

This can be seen in FIG. 2, where the handle 2 has been rotated to a point where the first principal function is activated (position "I"). This first principal function is the "Landaulette" function in the embodiment shown, where the back window of the car is opened. With the handle 2 and the cover 3 in this position, a control 4 becomes visible and accessible to the user. Using this control 4, a wind deflector can be opened in order to reduce drafts flowing onto the passengers.

In FIG. 3 the handle 2 has been turned farther; then the "top down" position (position "III") is activated. The cover 3 joined to the handle 2 is then turned to a point where, in addition to the control 4 for operating the wind deflector, another control 5 becomes visible and can be operated by the user to deploy a roll bar.

When the principal functions are again deactivated, the controls 4 and 5 of the secondary functions are again concealed. A provision can be made for the secondary functions to be also positively deactivated when the principal functions are deactivated. This can be achieved if the deactivation of the secondary functions is caused as soon as the principal function is deactivated via the control which governs the rotary switch. Similarly, a provision can be made for the controls 4 and 5 to be transferred positively to an "off" position when they are swept over by the cover 3 as the principal function is deactivated. Also shown is a position II. When the control 1 is brought into this position, all of the side windows of the car are opened.

The switch arrangement according to the present invention improves the visibility of the controls. During use in a motor vehicle as described, it also proves advantageous that (during night driving) fewer lights are visible on the dashboard which further improves the operational safety of the vehicle.

Figure 4:
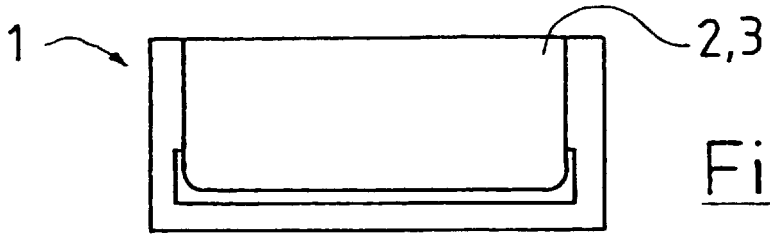
FIGS. 4 through 8 show a different configuration of a switch arrangement.
Figure 5:
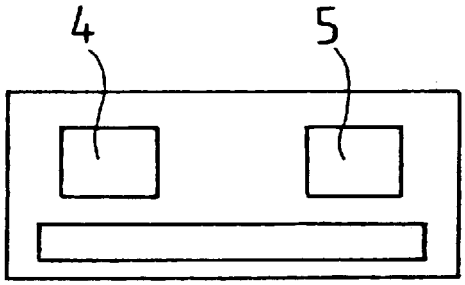

FIGS. 4 through 8 show another embodiment of a switch arrangement for the operation of the hood of a motor vehicle which can be opened and closed electrically. Shown in FIGS. 4 and 5 is a top view of the switch arrangement. The control 1 can no longer (in this case) be divided into a handle 2 and a cover 3. Instead, the cover 3 in this embodiment is also the handle 2.

FIG. 4 shows the switch arrangement with the control 1 in a position which corresponds to the closed hood. As the control 1 which corresponds to the cover 3 (as explained) is folded away in a swinging motion, the principal function is activated. This causes the hood to open.

In the embodiment as shown in FIG. 5, the cover 3 is lowered. At this point, two additional controls 4 and 5 are shown, with which a wind deflector or a roll bar, for example can be operated.

Figure 6:
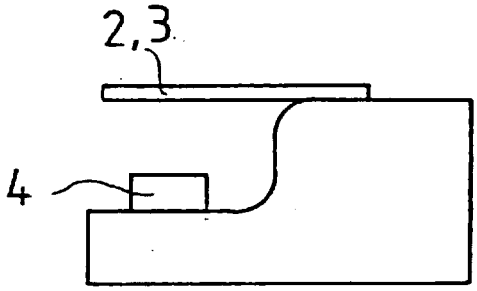
Figure 7:
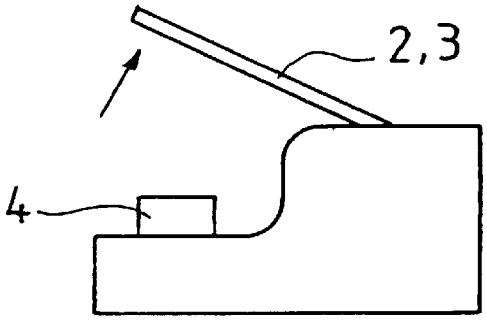
Figure 8:
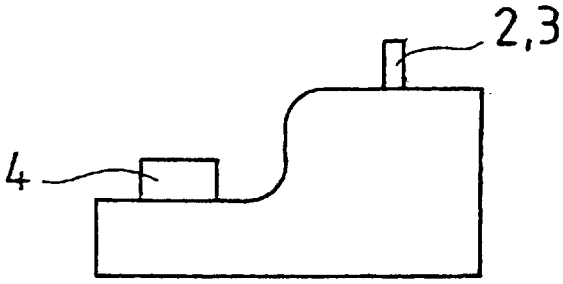

FIGS. 6 through 8 show the switch arrangement in a side view. As seen in FIG. 6, the cover 3, and with it the control 1, in the switch position that corresponds to a closed hood, overlaps the control 4 of a secondary function. Since the cover 3 is freely suspended at its front edge, it can easily be accessed by the user to operate the hood switch. It is also possible to provide a finger recess for easier operation.

The hood is opened when the user lifts up the cover 3 in a pivoting motion, as is represented in FIG. 7. The hood is then opened.

FIG. 8 shows the position of the cover 3 with the hood open. As shown in FIG. 8, the cover 3 is retracted in this position. Furthermore, at least one additional control 4 appears via which a secondary function can be operated. This secondary function is to be operable only when the principal function is turned on. This secondary function can be the wind deflector or also a roll bar, for example The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A switch arrangement for switching a principal function and at least one secondary function such that the at least one secondary function is activateable whenever the principal function is activated, comprising:

a cover; and at least one control for operating the at least one secondary function; wherein:

the control for operating the at least one secondary function is covered when the principal function is deactivated; and to permit activation of the at least one secondary function, the cover must be moved such that the at least one control is visible and accessible when the principal function is activated.

2. The switch arrangement according to claim 1, wherein the cover is mechanically coupled to a control piece for activating the principal function.

3. The switch arrangement according to claim 2, wherein the cover comprises the control piece, forming a handle for activating the principal function.

4. The switch arrangement according to claim 2, wherein the control piece for activating the principal function is a slide switch.

5. The switch arrangement according to claim 3, wherein the control piece for activating the principal function is a slide switch.

6. The switch arrangement according to claim 2, wherein the control piece for activating the principal function is a rotary switch.

7. The switch arrangement according to claim 2, wherein the control piece for activating the principal function is a rotary switch.

8. The switch arrangement according to claim 5, wherein the cover covers sectors of a circle along an axis of rotation of the rotary switch, and rotates with the rotary switch when the rotary switch is operated.

9. The switch arrangement according to claim 1, wherein the at least one control is one of a pushbutton switch, a toggle switch and a momentary contact switch for switching the at least one secondary function.

10. The switch arrangement according to claim 1, wherein via the control piece for activating the principal function, different principal functions can be switched, based on the position of the control piece, and the cover is moved in unison with the control piece such that the at least one control for operating the at least one switchable secondary function becomes visible, accessible and switchable based on the activated principal function.

11. The switch arrangement according to claim 1, wherein upon the movement of the control piece for activating the principal function to an "OFF" position, the at least one control is covered by the cover, and the principal function and corresponding secondary functions of the at least one control are deactivated.

12. The switch arrangement according to claim 1, wherein the switch arrangement is in a motor vehicle.

13. A switch arrangement for switching a principal function and at least one secondary function in an automobile, comprising:

a control piece for controlling the principal function;

a cover coupled to the control piece; and a control piece for controlling the at least one secondary function;

wherein the control piece for controlling the at least one secondary function is covered when the principal function is deactivated, and to permit activation of the at least one secondary function, the cover moves such that the at least one control is visible and accessible when the principal function is activated.

14. A switch arrangement for switching a principal function and at least one secondary function in an automobile, comprising:

a first switch element for controlling an operating mode of said principal function; and a second switch element for controlling an operating mode of said at least one secondary function;

wherein said first switch element is movable between a first switching position in which the principal function is in a first operational mode and said second switch element is inaccessible, and at least a second switching position in which said principal function is in a second operating mode and said second switch element is accessible to control an operating mode of said secondary function.

15. The switch arrangement according to claim 14, wherein said principal function is deactivated in said first operating mode and is activated in said second operating mode.

16. The switch arrangement according to claim 14, wherein said first switch element includes a member which covers said second switch element when said first switch element is in said first switching position and which exposes said second switch element when said first switch element is in said second switching position.

17. The switch arrangement according to claim 15, wherein said first switch element includes a member which covers said second switch element when said first switch element is in said first switching position and which exposes said second switch element when said first switch element is in said second switching position.

* * * * *